US009550382B2

(12) United States Patent
Nakayama et al.

(10) Patent No.: US 9,550,382 B2
(45) Date of Patent: Jan. 24, 2017

(54) TAPE CARTRIDGE AND TAPE PRINTING DEVICE

(71) Applicant: Seiko Epson Corporation, Tokyo (JP)

(72) Inventors: Tetsu Nakayama, Matsumoto (JP); Haruki Sugawara, Matsumoto (JP); Tomoyuki Kubota, Matsumoto (JP); Daisuke Sato, Azumino (JP); Saeko Inoue, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/774,185

(22) PCT Filed: Mar. 14, 2014

(86) PCT No.: PCT/JP2014/001462
§ 371 (c)(1),
(2) Date: Sep. 10, 2015

(87) PCT Pub. No.: WO2014/148022
PCT Pub. Date: Sep. 25, 2014

(65) Prior Publication Data

US 2016/0031237 A1 Feb. 4, 2016

(30) Foreign Application Priority Data

Mar. 22, 2013 (JP) ..... 2013-059760
Feb. 19, 2014 (JP) ..... 2014-029877

(51) Int. Cl.
*B41J 15/04* (2006.01)
*B41J 17/32* (2006.01)
*B41J 3/407* (2006.01)

(52) U.S. Cl.
CPC ..... *B41J 15/044* (2013.01); *B41J 3/4075* (2013.01); *B41J 17/32* (2013.01)

(58) Field of Classification Search
CPC ..... B41J 3/4075; B41J 15/044; B41J 17/32
See application file for complete search history.

(56) References Cited

U.S. PATENT DOCUMENTS 3,682,407 A * 8/1972 Lichtenstein ..... B41J 11/58 235/2
2005/0196038 A1* 9/2005 Tanaka ..... G06T 11/203 382/162

(Continued)

FOREIGN PATENT DOCUMENTS

CN 1663791 A 9/2005
JP 2000-62251 A 2/2000

(Continued)

OTHER PUBLICATIONS

Search Report received in International Application No. PCT/JP2014/001462, May 20, 2014.

*Primary Examiner* — Sarah Al Hashimi
(74) *Attorney, Agent, or Firm* — ALG Intellectual Property, LLC

(57) ABSTRACT

A tape cartridge has a print tape accommodated in a cartridge case, a slit-like reel-off port through which the print tape is sent out, and first and second sub display sections which are provided on the wall surface of a forward peripheral wall of the cartridge case where the reel-off port is formed, and in which the type of the print tape is displayed in letters. In the first and second sub display sections, the type of the print tape is displayed in the form of at least one of normal letters formed according to the reel-off port as a horizontal reference and inverted letters formed by inverting the normal letters upside down.

14 Claims, 7 Drawing Sheets

(56) References Cited

U.S. PATENT DOCUMENTS

| | | | | |
|---|---|---|---|---|
| 2011/0102846 | A1 | 5/2011 | Tanaka et al. | |
| 2012/0327438 | A1* | 12/2012 | Tanaka | G06T 11/203 358/1.11 |

FOREIGN PATENT DOCUMENTS

| | | | |
|---|---|---|---|
| JP | 2008-265180 | A | 11/2008 |
| JP | 1344112 | S | 11/2008 |

* cited by examiner

TAPE CARTRIDGE AND TAPE PRINTING DEVICE

CROSS-REFERENCE TO RELATED APPLICATIONS

The entire disclosures of Japanese Patent Application No. 2013-059760 filed Mar. 22, 2013, and Japanese Patent Application No. 2014-029877 filed Feb. 19, 2014, are expressly incorporated by reference herein.

BACKGROUND

Technical Field

The present invention relates to a tape cartridge which accommodates a print tape and which has a display section where the type of the accommodated print tape is displayed, and a tape printing device.

Background Art

According to the related art, a tape cassette having a tape arranged therein and a tape printing device for printing on the tape reeled off from the tape cassette are known (see JP-A-2000-62251).

The tape cassette includes a case made up of an upper case and a lower case, and a film tape (print tape) and a thermal ink ribbon arranged inside the case. A tape specifying display section where the tape width of the film tape is displayed in letters is bonded to the surface of the upper case.

Meanwhile, the tape printing device produces a desired lettered tape (label) on the basis of a print command from a personal computer to which the device is connected. The tape printing device includes a device main body, a cassette loading section which is arranged inside the device main body and in which the above tape cassette is loaded, and an open/close lid which opens and closes the cassette loading section.

The top surface of the device main body is formed as a convex arcuate surface, and to follow this surface, the open/close lid is formed in a convex arcuate shape. A window covered with a transparent cover is formed in the open/close lid, and the tape specifying display section provided on the top surface of the tape cassette is visible through the window. Also, a slit-like tape discharge port extending in an up-and-down direction is provided on the forward side of the device main body. Moreover, the cassette loading section is inclined so as to be lower on the forward side at an inclination angle of 20°. Thus, the tape cassette can be easily loaded and the film tape after printing can be easily discharged from the tape discharge port.

SUMMARY OF INVENTION

In such a related-art tape printing device, the tape width described in the tape specifying display section can be easily confirmed through the window at the time of printing. However, since the tape discharged from the tape discharge port is in a vertical posture, there is a problem that the print content cannot be confirmed easily and instantly. However, if the tape cassette is configured to be set in a horizontal posture so that the print content can be confirmed easily, the tape specifying display section is then located on the lateral side. Therefore, there is no other choice but to look inside from the lateral side to confirm the tape width and therefore it is difficult to confirm the tape width.

It is an object of the invention to provide a tape printing device in which the type of the print tape can be easily confirmed and in which the print content on the print tape that is discharged can be easily confirmed, and a tape cartridge suitably used in this tape printing device.

A tape cartridge according to the invention includes: a cartridge case; a print tape accommodated in the cartridge case; a slit-like tape outlet which is formed in the cartridge case and through which the print tape is sent out; and a first display section which is provided on a first surface of the cartridge case where the tape outlet is formed, and in which a type of the print tape is displayed. In the first display section, the type of the print tape is displayed in at least one of normal letters formed according to the tape outlet as a horizontal reference and inverted letters formed by inverting the normal letters upside down.

In this case, it is preferable that the first display section is provided on one of a surface on the side of a print surface of the print tape that is sent out and a surface on the side of a non-print surface, split by the tape outlet as a boundary, on the first surface.

According to these configurations, since the first display section is provided on the first surface of the cartridge case where the tape outlet is formed, the first display section and the one surface of the print tape sent out from the tape outlet can be easily confirmed without largely moving one's eyes. Also, since letters or the like showing the type of the tape in the form of at least one of normal letters and inverted letters are displayed in the first display section, the display of the letters or the like in the first display section can be confirmedly without any error and instantly, even if the first display section is provided on the upper side or lower side from the tape outlet. For example, when printing is carried out on the print tape, the print content and the type of the print tape displayed in the first display section can be confirmed easily.

Also, it is preferable that a second display section where the type of the print tape is displayed in letters or the like is further provided on a second surface of the cartridge case located to the forward side in a direction in which the tape cartridge is loaded, and that letters or the like showing the type of the tape in the form of at least one of normal letters formed according to the tape outlet as a horizontal reference and inverted letters are displayed, as the type of the print tape, in the second display section.

According to this configuration, since letters or the like showing the type of the tape in the form of at least one of normal letters and inverted letters are displayed in the second display section, the display of the letters or the like in the second display section can be confirmed without any error from the lateral side, that is, the type of the print tape can be confirmed without any error, regardless of the posture at the time of use.

Moreover, it is preferable that a case wall of the cartridge case forming the second surface is formed in such a way that a wound state of the print tape is visible.

According to this configuration, the amount of the remaining print tape can be confirmed with the type of the print tape, from the lateral side.

A tape printing device according to the invention includes: a tape loading section in which the above tape cartridge is loaded in such a way that the print surface of the print tape at a reel-off end part faces upward; a print unit having a print head arranged to face downward to the reel-off end part; a device case in which the tape loading section and the print unit are arranged and which has a tape discharge port through which the print tape is discharged in a posture with the print surface facing upward; and a first opening which is formed on a first outer surface of the device case where the tape discharge port is formed, and which is formed in such away that the first display section of the tape cartridge is visible.

In this case, it is preferable that the first display section is provided on a surface on the upper side that is a surface on the side of the print surface of the print tape, on the first surface, and that the first opening is provided on an outer surface on the upper side of the tape discharge port, on the first outer surface.

Also, it is preferable that the first outer surface is a forward surface of the device case.

According to these configurations, via the first opening, the type of the print tape can be easily confirmed and the print content on the print tape discharged from the tape discharge port can be easily confirmed. Particularly, a user who carries out a print operation can instantly confirm the type of the print tape and the print content, viewing the device case on the front. Therefore, if an error is made in the type and the print content, the user can quickly cope with the error by stopping the printing or the like. Therefore, unnecessary consumption of the print tape can be restrained.

In this case, it is preferable that the first opening is open, extending upward with respect to the first display section.

According to this configuration, sufficient room light can be taken, via the first opening, into the first display section of the tape cartridge loaded in the cartridge loading section. Also, the first opening can be set in a position and size that takes into account the eyes of a user sitting on a chair. Thus, the visibility of (the first display section of) the tape cartridge can be improved.

Also, it is preferable that the tape cartridge is loaded removably in the cartridge loading section from the lateral side, and that the first opening communicates with the cartridge loading section and is opened to the lateral side.

According to this configuration, at the time of loading or removing the tape cartridge into or from the cartridge loading section, the first opening can be used as a "finger hook port" (a part in which a finger is inserted) for the thumb or the like holding the tape cartridge. Therefore, the cartridge loading section can be formed in a compact size without impairing the easiness of loading/removal of the tape cartridge. The tape printing device can be miniaturized accordingly.

In this case, it is preferable that the device further includes an open/close lid which opens and closes the cartridge loading section, and a second opening which is provided in the open/close lid and through which the second display section and the wound state of the print tape are visible over the case wall.

According to this configuration, the second display section can be confirmed through the second opening. Also, the amount of the remaining tape of the print tape, which cannot be confirmed through the first opening, can be visually confirmed via the second opening.

In this case, it is preferable that the first opening is provided with a first opening cover having light transmissivity with respect to visible light, and that the first opening cover is attached to the open/close lid.

According to this configuration, entry of dust into the cartridge loading section (inner loading section) can be prevented effectively by the first opening cover. Also, since the first opening cover is attached to the open/close lid, the function of the first opening as the "finger hook port" is not impaired.

Also, in this case, it is preferable that the first opening cover has a finger hook part for causing the open/close lid to open and close.

According to this configuration, the finger hook part of the open/close lid can be provided in a simple and inconspicuous form.

Also, it is preferable that the second opening is provided with a second window cover having light transmissivity with respect to visible light, and that the first opening cover and the second opening cover are molded as an integrated part and attached to the open/close lid.

According to this configuration, the first opening cover and the second opening cover can be easily formed without increasing the number of components and these can be easily attached to the open/close lid. Also, replacement of the first opening cover and the second opening cover can be carried out easily. It is preferable that the first opening cover and the second opening cover are attached to the open/close lid in a snap-in form.

Meanwhile, it is preferable that a lower edge surface forming the first opening is made up of a light reflection surface.

According to this configuration, room light can be reflected toward the first display section of the tape cartridge and the visibility of the first display section can be improved further.

DESCRIPTION OF EMBODIMENTS

Hereinafter, a tape cartridge and a tape printing device according to an embodiment of the invention will be described, referring to the accompanying drawings. This tape printing device is connected to information (mobile terminal) such as a personal computer, smartphone or tablet via wireless (for example, wireless LAN) connection or wired (for example, LAN cable or USB cable) connection, and carries out a series of print processing (including cutting processing) on a print tape on the basis of print data received from these information terminals. Therefore, this tape printing device is not provided with a keyboard or display and is configured with the functions of reeling off a print tape from a tape cartridge loaded therein, performing printing, and cutting the printed part, and the like.

Also, this tape printing device has the shape of a vertically long rectangular parallelepiped so as to be installed in a narrow space on a desk. Moreover, on the forward surface of the tape printing device, a window that is an opening through which the loaded tape cartridge is visible and a tape discharge port through which the printed tape is discharged are provided. Hereinafter, the tape printing device having the window (opening) formed on the forward surface thereof will be described. However, before that, the tape cartridge that is visually confirmed through this window will be described. As described above, this embodiment is described, referring the side where the tape discharge port is formed, of the tape printing device of FIG. 2, as "forward", the opposite side as "rear", the right-hand side when facing the forward side as "right", the left-hand side as "left", the upper side as "upper", and the bottom side as "lower". Also, with respect to the tape cartridge, similarly to the tape printing device, the descriptions of forward and rear, left and right, and upper and lower are given, using the loaded state as a reference.

[Configuration of Tape Cartridge 70]

Figure 1A:
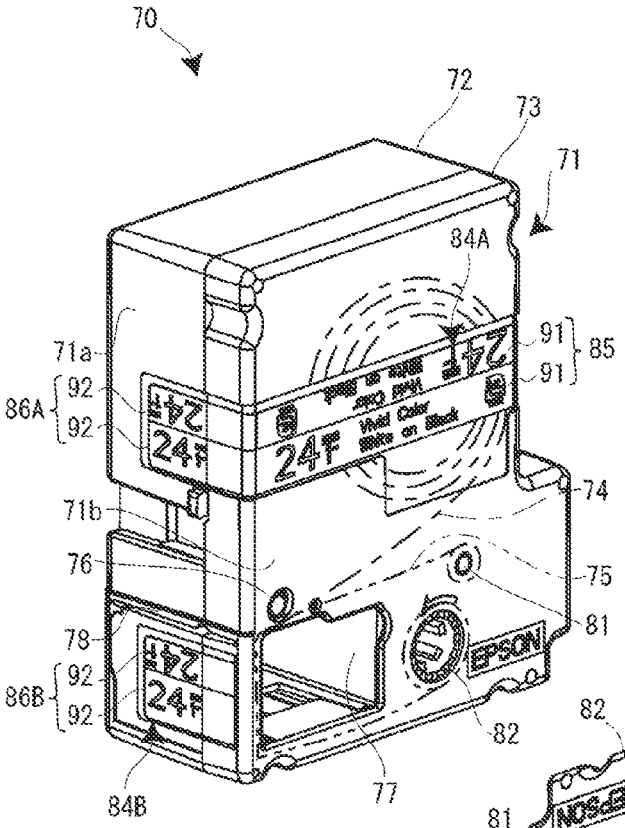
FIG. 1 is an external perspective view of a tape cartridge according to first and second embodiments.
Figure 1B:
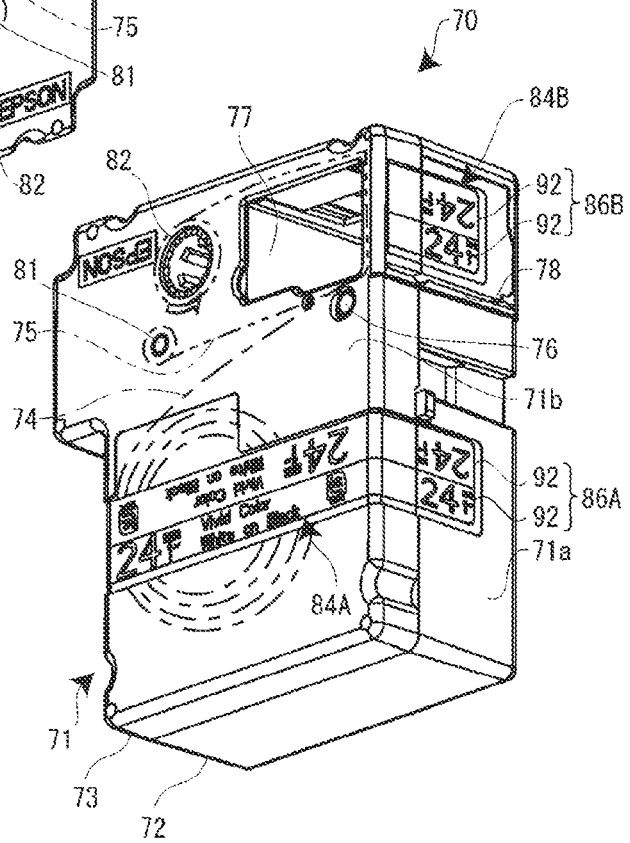

FIG. 1 is an external perspective view of a tape cartridge. As shown in FIG. 1, a tape cartridge 70 has: a cartridge case 71 including a main body case 72 and a lid case 73; and a print tape 74, an ink ribbon 75 and a platen 76 accommodated in the cartridge case 71. The main body case 72 and the lid case 73 are resin-molded components having the same contour shape of "L". The lid case 73 is made of a transparent (transparent to visible light) resin so that the inside of the cartridge case 71 is visible from the front of the lid case 73.

In an upper part of the cartridge case 71 as viewed from the side of the lid case 73, the print tape 74 in the wound state is accommodated in a way that enables reeling off. Also, a rectangular opening 77 in which a print head 21, later described, is placed, is formed on the left-hand side of a lower part of the cartridge case 71. The platen 76 is installed above the rectangular opening 77. A reel-off port 78 (tape outlet) for the print tape 74 is formed in a forward peripheral wall 71*a* of the cartridge case 71, and a reel-off end part of the print tape 74 held between the platen 76 and the print head 21 is reeled off from this reel-off port 78 while printing is performed by the print head 21.

Also, the ink ribbon 75 is accommodated in the state of being wound on a reel-off core 81 and a take-up core 82, on the right-hand side of the lower part of the cartridge case 71. The ink ribbon 75 reeled off from the reel-off core 81 moves in parallel with the print tape 74, faces the platen 76 and the print head 21, goes around the outer side of the rectangular opening 77, and is taken up on the take-up core 82.

Meanwhile, on the outer surface of the cartridge case 71, a band-like first label 84A is bonded in such a way as to traverse a front wall 71*b* and the forward peripheral wall 71*a*. More specifically, the band-like first label 84A is bonded in such a way as to traverse the wall surface of the front wall 71*b* (second surface) and the wall surface of the forward peripheral wall 71*a* (first surface). In addition, on the wall surface of the forward peripheral wall 71*a* (first surface), a second label 84B is bonded on the opposite side of the reel-off port 78 from the first label 84A.

A main display section 85 (second display section) is formed at the part of the first label 84A on the side of the front wall 71*b*, and two main type indications 91 are printed with one on top of the other in the main display section 85 (details will be described later). In each main type indication 91, the tape width and tape color that show the type of the print tape 74, and the ink color or the like of the ink ribbon 75 are displayed using letters and symbols (hereinafter simply referred to as "letter display").

Meanwhile, a first sub display section 86A (first display section) is formed at the part of the first label 84A on the side of the forward peripheral wall 71*a*, and two sub type indications 92 are printed with one on top of the other in the first sub display section 86A (details will be described later). In this case, too, in each sub type indication 92, the tape width and tape color of the print tape 74, and the ink color or the like of the ink ribbon 75 are displayed using letters and symbols (hereinafter simply referred to as "letter display").

Similarly, a second sub display section 86B (first display section) is formed on the second label 84B. In this case, on the wall surface of the forward peripheral wall 71*a*, the second sub display section 86B is arranged on the upper side from the reel-off port 78 and the first sub display section 86A is arranged on the lower side. In the second sub display section 86B, too, two sub type indications 92 are printed with one on top of the other (details will be described later). In each sub type indication 92, the tape width and tape color of the print tape 74, and the ink color or the like of the ink ribbon 75 are displayed in the form of letter display.

As will be described in detail later, in a tape printing device 1 according to a first embodiment, the tape cartridge 70 is used in a normal vertical posture (see FIG. 1(*a*)), and in a tape printing device 1A according to a second embodiment, the tape cartridge 70 is used in an inverted vertical posture where the tape cartridge is inverted upside down (see FIG. 1(*b*)). In view of the method for using the tape cartridge 70, one (the upper side) of the upper and lower main type indications 91 in the foregoing main display section 85 is displayed in normal letters, and the other (the lower side) is displayed in inverted letters formed by inverting the normal letters upside down. Similarly, one (the upper side) of the upper and lower sub type indications 92 in the first and second sub display sections 86A, 86B is displayed in normal letters, and the other (the lower side) is displayed in inverted letters.

Thus, whether the tape cartridge 70 is used in the normal vertical posture or used in the inverted vertical posture, the type of the print tape 74 installed therein can be easily confirmed. Also, the type of the print tape 74 can be easily confirmed from both the forward side and the front side of the tape cartridge 70. It should be noted that the normal letters may be arranged on the lower side and that the inverted letters may be arranged on the upper side.

Meanwhile, the foregoing first label 84A is bonded corresponding to a vertically intermediate position with respect to the accommodated print tape 74 in the wound state, and the amount of the remaining tape of the wound print tape 74 can be visually confirmed over the front wall 71*b*, together with the main type indications 91 on the first label 84A.

Configuration of Tape Printing Device 1

First Embodiment

Figure 2:
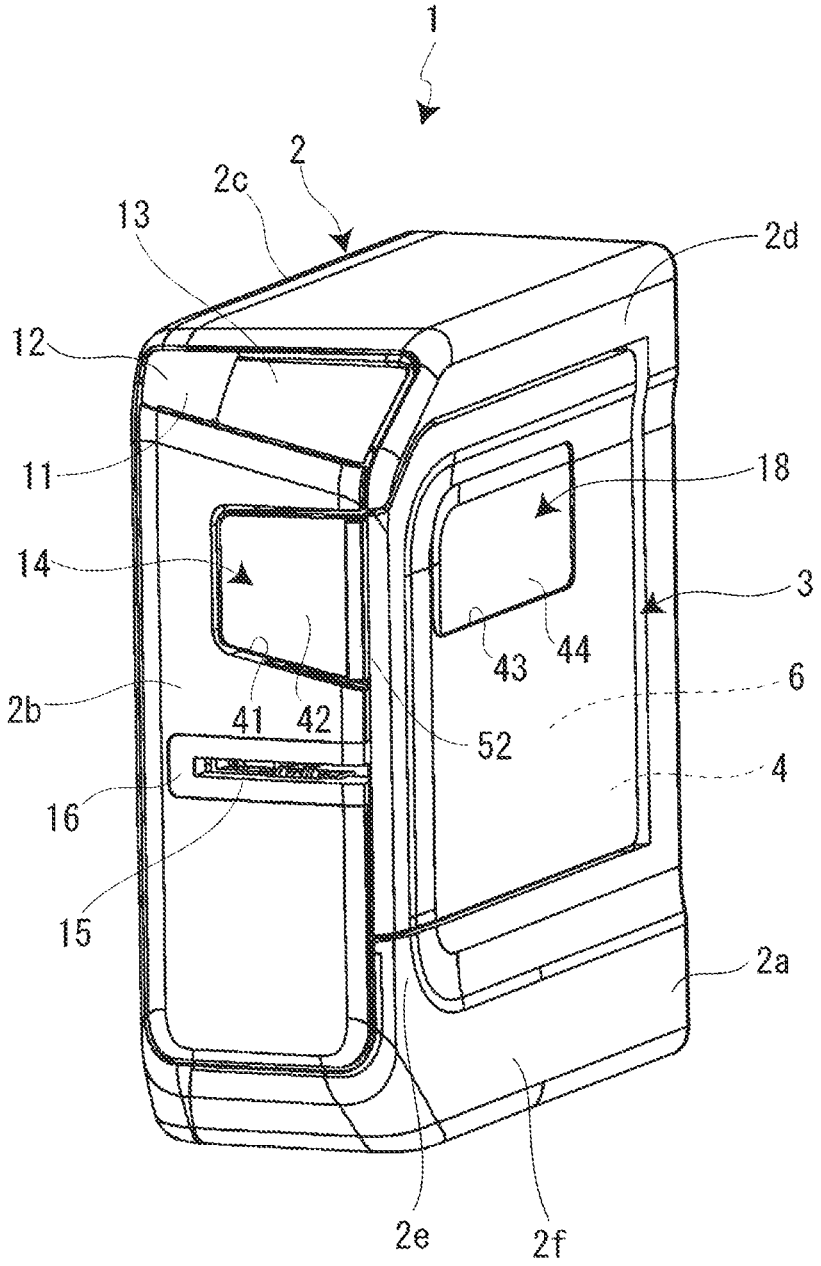
FIG. 2 is an external perspective view of a tape printing device according to the first embodiment.
Figure 3:
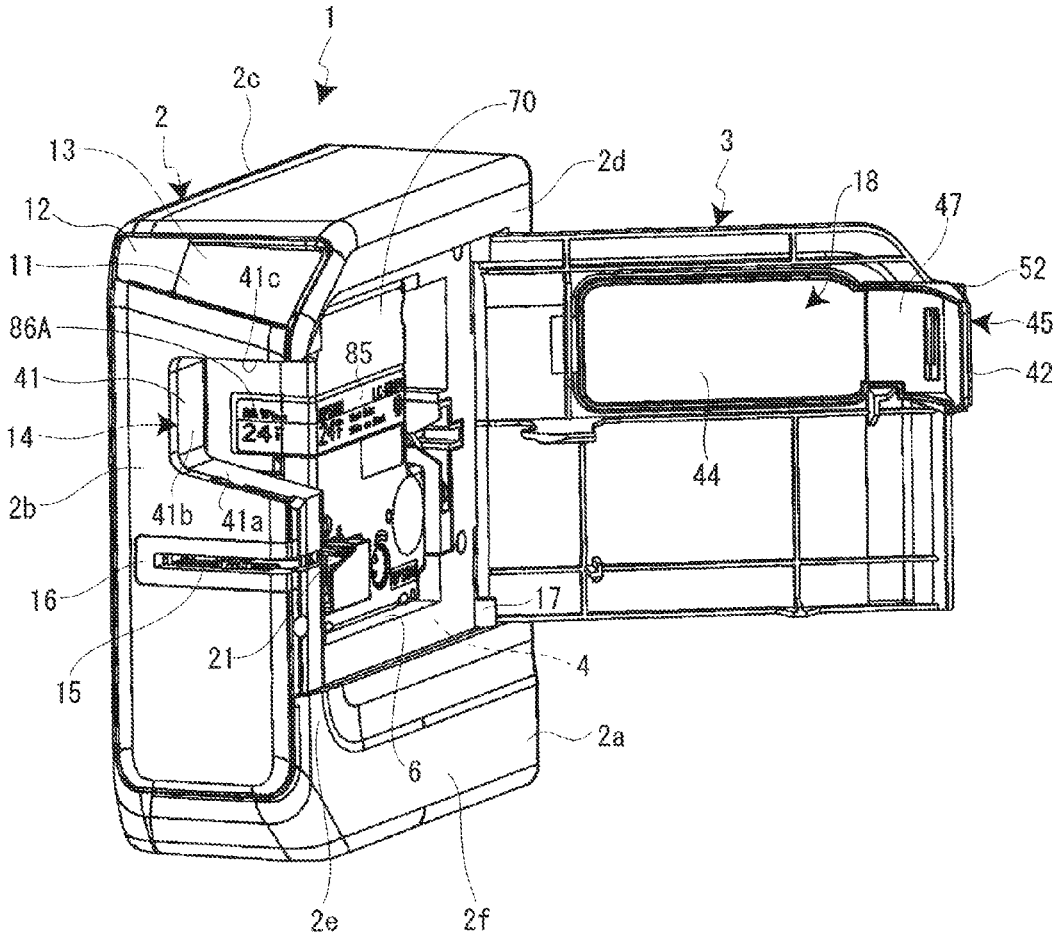
FIG. 3 is an external perspective view of the tape printing device in an open-lid state according to the first embodiment.

Next, the tape printing device will be described, referring to FIGS. 2 and 3. FIG. 2 is an external perspective view of the tape printing device installed with a tape discharge port 15, described later, facing forward. FIG. 3 is an external perspective view of the tape printing device in an open-lid state.

As shown in FIGS. 2 and 3, the tape printing device 1 has a device case 2 in the shape of a vertically long rectangular parallelepiped, an open/close lid 3 provided on a right-hand side surface 2*a* of the device case 2, and an internal device 4 arranged inside the device case 2. Also, a cartridge loading section 6 is formed as a recess on the inner side of the open/close lid 3, and the tape cartridge 70 can be removably loaded therein by opening the open/close lid 3.

An upper part of a forward surface 2*b* of the device case 2 is an inclined surface part 11 having an inclined threedimensional configuration. In this inclined surface part 11, a power button 12 and various lamps 13 are arranged. Also, a forward window 14 is formed below the inclined surface part 11, and the first sub display section 86A (sub type indications 92) of the loaded tape cartridge 70 can be visually confirmed through this forward window 14.

Moreover, the tape discharge port 15 continuing to the reel-off port 78 of the loaded tape cartridge 70 is formed at a vertically intermediate position on the forward surface 2*b* of the device case 2. The tape discharge port 15 is formed horizontally long, corresponding to the print tape 74 with a maximum width. The print tape 74 on which printing is performed by the internal device 4 is discharged from this tape discharge port 15.

Meanwhile, parts along an upper edge part 2*d*, a forward edge part 2*e* and a lower edge part 2*f*, of the right-hand side surface 2*a* and a left-hand side surface 2*c* of the device case 2, are slightly protruding in comparison with the other parts. That is, in this tape printing device 1, on the right-hand side surface 2*a* and the left-hand side surface 2*c*, the center part is slightly recessed in comparison with the sideways "U"-shaped edge part. In addition, this provides a form that is less likely to cause slip when the user holds the upper part or forward part to carry the tape printing device 1. Also, the upper part of the open/close lid 3 provided on the right-hand side surface 2*a* is slightly bulging out.

As described above, the open/close lid 3 is provided on the right-hand side surface 2*a* of the device case 2, and the forward end of the open/close lid 3 extends to the position of the forward surface 2*b* of the device case 2. A hinge 17 is provided at a rear end part of the open/close lid 3, and the open/close lid 3 opens and closes in forward and backward directions about this hinge 17. As the open/close lid 3 opens, the cartridge loading section 6 is opened largely and it is possible to attach and remove the tape cartridge 70. Also, a horizontally long side window 18 is provided in an upper part of the open/close lid 3. Thus, the main display section 85 (main type indications 91) of the loaded tape cartridge 70 and the amount of the remaining tape of the print tape 74 are visible through this side window 18. The structures of the foregoing forward window 14 and side window 18 will be described in detail later.

Figure 4:
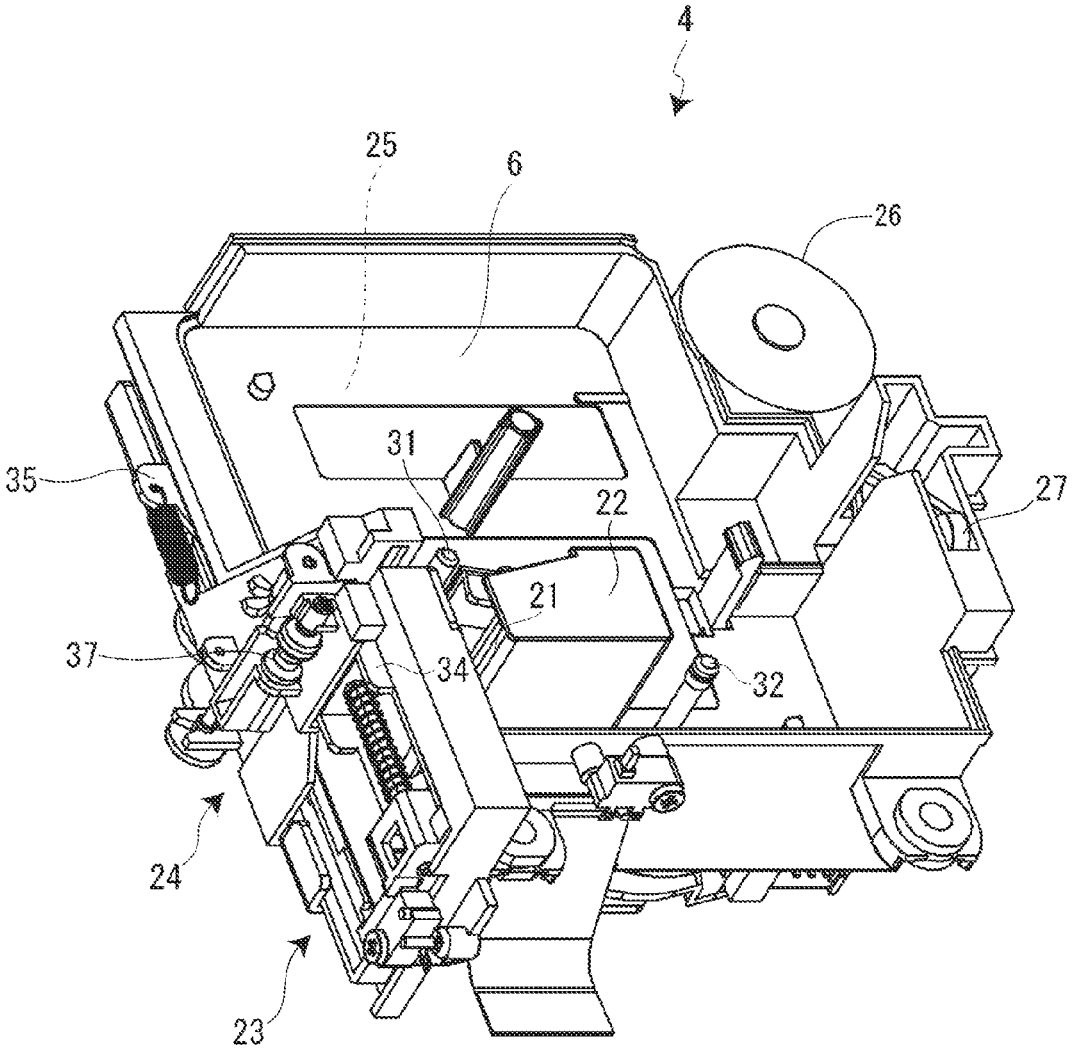
FIG. 4 is a perspective view showing an internal device of the tape printing device according to the first embodiment.

As shown in FIG. 4, the internal device 4 has the print head 21 (print unit), which is placed in the rectangular opening 77 of the tape cartridge 70 loaded in the cartridge loading section 6 and which is covered by a head cover 22. Also, the internal device 4 has a sawing-type cutter mechanism 23 arranged downstream of and very closely to the print head 21, and a tape discharge mechanism 24 arranged downstream of and very closely to the cutter mechanism 23. Moreover, the internal device 4 has: a drive mechanism 25 which is arranged on the back side of the cartridge loading section 6 and which carries out print-feed of the print tape 74 and the ink ribbon 75 and the actuation of the cutting by the cutter mechanism 23; a motor 26 forming the drive source of the drive mechanism 25; and a head release mechanism 27 which rotates the print head 21, interlocked with the opening/closing of the open/close lid 3.

Although not illustrated, the drive mechanism 25 is made up of a clutch, a gear train and the like, and transmits the forward motive power of the motor 26 to a platen shaft 31 and a take-up core shaft 32 protruding in the cartridge loading section 6. Meanwhile, the backward motive power of the motor 26 is transmitted to the cutter mechanism 23 via the clutch, the gear train and a cam. The cutter mechanism. 23 has a cutter holder 34 with a cutter blade, and an actuation rod 35 which causes the cutter blade to perform a cutting operation via the cutter holder 34. As this actuation rod 35 moved forward and backward via the cam of the drive mechanism 25, the cutting operation by the cutter blade is carried out. Also, the tape discharge mechanism 24 has a discharge roller 37, and the discharge roller 37 rotates on receiving the motive power from the actuation rod 35 and discharges the print tape 74 after the cutting, from the tape discharge port 15.

The reel-off end of the print tape 74 accommodated in the tape cartridge 70 is slightly protruding from the reel-off port 78, and in this state, the tape cartridge 70 is loaded in the cartridge loading section 6. As the tape cartridge 70 is loaded in the cartridge loading section 6, the foregoing platen 76 fits with the platen shaft 31, and the take-up core 83 fits with the take-up core shaft 32. Subsequently, as the open/close lid 3 is closed, the print head 21 rotates to the print position via the head release mechanism 27. As the print head 21 rotates to the print position, the print tape 74 and the ink ribbon 75 are held between the print head 21 and the platen 76, thus forming a print standby state.

Here, when a print command is inputted from the information terminal, the platen shaft 31 and the take-up core shaft 32 are rotated by the motor 26. The print tape 74 and the ink ribbon 75 are fed simultaneously and heat generation elements of the print head 21 are selectively driven. Thus, printing is carried out. As the print operation proceeds, the printed part of the print tape 74 is sent out of the device from the tape discharge port 15. Then, when the printing is complete, the print tape is fed by the amount of the margin and then the feeding of the print tape 74 stops. Here, the motor 26 rotates backward, actuating the cutter mechanism 23 and the tape discharge mechanism 24. The print tape 74 is cut and the printed part that is cut is discharged from the tape discharge port 15.

Next, the structures around the forward window 14 and the side window 18 will be described in detail, referring to FIGS. 2, 3, 5 and 6. The tape cartridge 70 is loaded in the cartridge loading section 6 in such a way that the first sub display section 86A thereof is located on the side of the forward surface 2*b* of the device case 2 and that the main display section 85 is located on the side of the right-hand side surface 2*a* (see FIG. 3). Then, in the forward surface 2*b* of the device case 2, the forward window 14 as a first opening is provided facing the first sub display section 86A, and in the open/close lid 3 provided on the right-hand side surface 2*a*, the side window 18 as a second opening is provided facing the main display section 85.

The forward window 14 has a forward window opening 41 (first window opening) communicating with the cartridge loading section 6, and a forward window cover 42 (first opening cover) covering the forward window opening 41. Similarly, the side window 18 has a side window opening 43 (second window opening) in the way of penetrating the open/close lid 3, and a side window cover 44 (second opening cover) covering the side window opening 43. In this case, the forward window opening 41, which faces the first sub display section 86A, in practice, is open, extending upward with respect to the first sub display section 86A. Similarly, the side window opening 43 is open, extending upward with respect to the main display section 85. Thus, the first sub display section 86A and the main display section 85 located at the inner positions are easily visible to the eyes from oblique above. Also, as described in detail later, the forward window cover 42 and the side window cover 44 are formed as an integrated component forming a cover unit 45, and are attached to the open/close lid 3 as the cover unit 45 (see FIG. 3).

The forward window opening 41 is inclined obliquely so that the lower side is parallel to the line of the foregoing inclined surface part 11, and is open in a trapezoidal shape as a whole. The side on the right-hand side surface 2*a*, of this forward window opening 41 in the trapezoidal shape, is opened similarly to the cartridge loading section 6 and functions as a "finger hook port" in which the thumb is inserted when loading the tape cartridge 70. Also, the forward window cover 42 attached to the open/close lid 3 as the cover unit 45 is placed to close the forward window opening 41 from the side of this open part as the open/close lid 3 closes.

Meanwhile, the cartridge loading section 6 is provided at a slightly retreated position in consideration of the installation space for the foregoing cutter mechanism 23 and tape discharge mechanism 24 on the forward side. Therefore, the forward window opening 41 communicating with the cartridge loading section 6 has a depth corresponding to the foregoing installation space. Then, the main part of the cutter mechanism 23 and the tape discharge mechanism 24 are arranged inside below a lower-side wall 41*a* of the forward window opening 41, and the actuation rod 35 of the cutter mechanism 23 is arranged inside on the back side of a lateral-side wall 41*b*. In this case, an upper-side wall 41*c*, the lateral-side wall 41*b* and the lower-side wall 41*a* of the forward window opening 41 are in a bright color similar to the five surfaces other than the forward surface 2*b* of the device case 2. Particularly, the surface (lower edge surface) of the lower-side wall 41*a* functions as a light reflection surface which reflects room light (illuminating light and external light) toward the first sub display section 86A. Also, this surface of the lower-side wall 41*a* may be a mirror surface.

Figure 5:
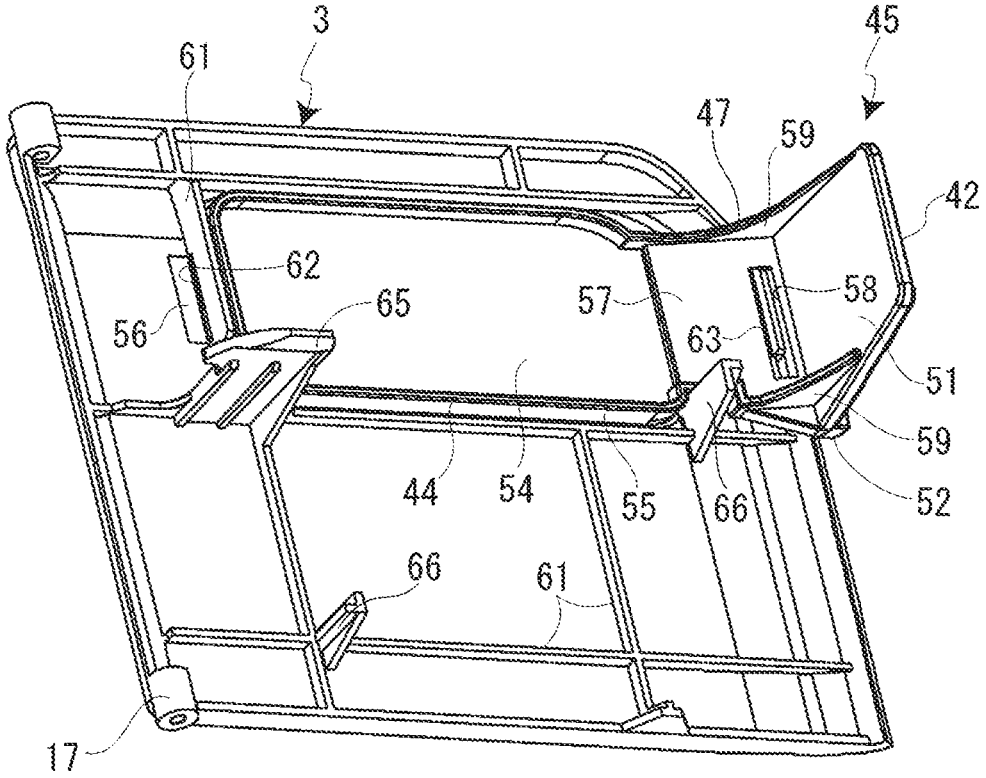
FIG. 5 is a perspective view of an open/close lid of the tape printing device according to the first embodiment, as viewed from the back side.
Figure 6:
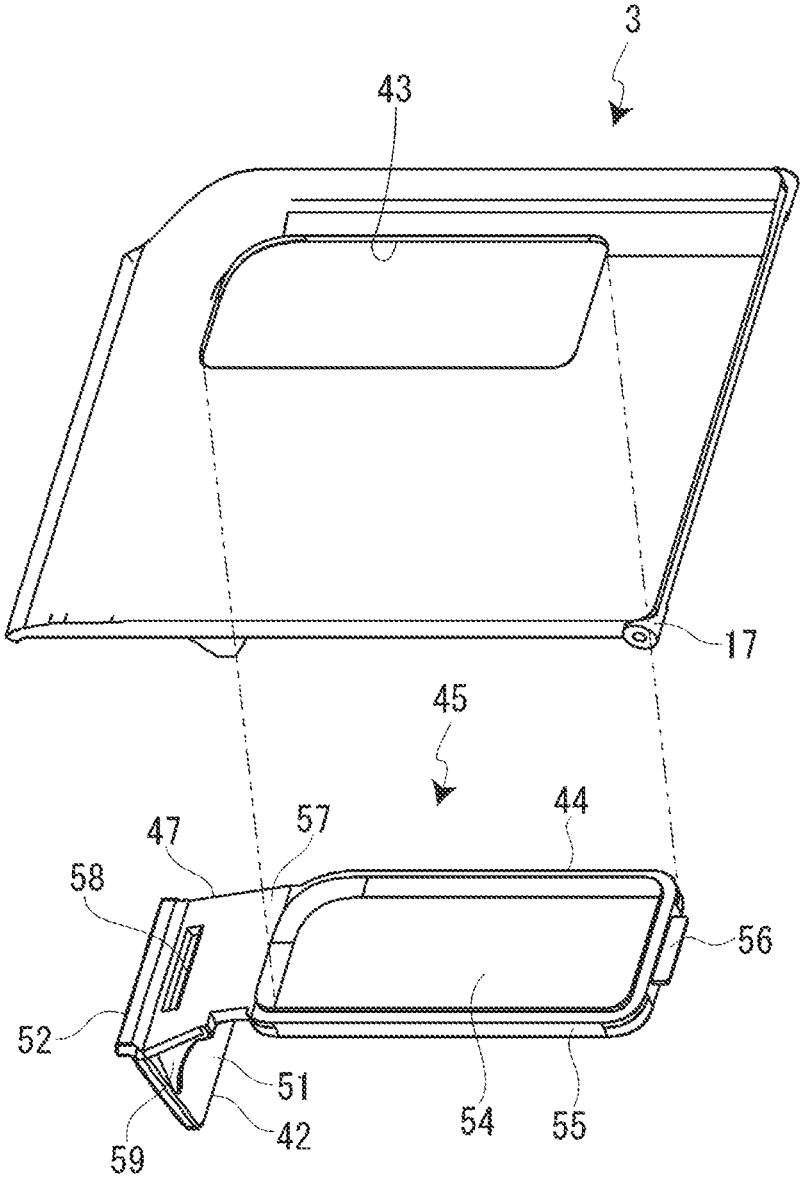
FIG. 6 is an open/close exploded perspective view of the open/close lid of the tape printing device according to the first embodiment, as viewed from the surface side.

As shown in FIGS. 5 and 6, the cover unit 45 is formed by including the forward window cover 42, the side window cover 44 and a connection plate part 47, and is molded into an integrated component with "L"-shaped cross section made of a transparent resin. The forward window cover 42 has a forward cover main body 51 in a complementary shape (trapezoidal shape) with the opening shape of the forward window opening 41 in the trapezoidal shape, and a finger hook part 52 protruding at the base part of the forward cover main body 51. This finger hook part 52 functions as a part on which the user places a finger when opening the open/close lid 3.

The side window cover 44 has a side cover main body 54 which is fitted from the back side into the side window opening 43 formed in the open/close lid 3, a frame part 55 provided to form a fringe on the side cover main body 54, and an engagement tongue 56 extending from one short side of the frame part 55. The side cover main body 54 is protruding from the frame part 55 by the amount of the thickness of the open/close lid 3. When the side window cover 44 is attached to the open/close lid 3 from the back side, the surface of the side cover main body 54 is flush with the surface of the open/close lid 3 (see FIG. 2). Also, the engagement tongue 56 is engaged with a slit hole 62 of a reinforcement rib 61 formed on the back side of the open/close lid 3, when the cover unit 45 is attached to the open/close lid 3.

The connection plate part 47 connects the base part of the forward window cover 42 with the other short side of the frame part 55 of the side window cover 44. The connection plate part 47 has a plate part main body 57 in which a slit-like engagement opening 58 is formed, and a pair of reinforcement parts 59 laid between the plate part main body 57 and the forward cover main body 51. The pair of reinforcement parts 59 are in the form of brackets and reinforce the forward window cover 42 extending in the "L"-shape from the connection plate part 47. The engagement opening 58 is engaged with an engagement protrusion 63 formed on the back side of the open/close lid 3, when the cover unit 45 is attached to the open/close lid 3.

That is, as the engagement tongue 56 is inserted in and engaged with the slit hole 62 in the open/close lid 3 and the engagement opening 58 is engaged with the engagement protrusion 63 on the open/close lid 3 in a snap-in form, the cover unit 45 is attached to the back side of the open/close lid 3. Also, on the back side of the open/close lid 3, the reinforcement rib 61 is provided laterally and longitudinally, and an actuation protrusion 65 for actuating the foregoing head release mechanism 27, and two holding protrusions 66 for holding the floating of the tape cartridge 70 are provided.

As described above, according to this embodiment, since the forward window 14 through which the first sub display section 86A of the tape cartridge 70 is visible is provided on the forward surface 2*b* of the device case 2, the presence/absence and type of the loaded tape cartridge 70 can be visually confirmed through the forward window 14 effortlessly, in the state where the tape printing device 1 is placed on a desk. That is, the type or the like of the tape cartridge 70 can be confirmed without changing the posture of the tape printing device 1 placed in a narrow space on the desk.

Also, since the forward window cover 42 is attached on the side of the open/close lid 3, the easiness of attachment and removable of the tape cartridge 70 is not impaired. Moreover, since the forward window cover 42 and the side window cover 44 are molded as an integrated part, these can be easily produced as the cover unit 45 and can be easily attached to the open/close lid 3. It should be noted that the shapes of the forward window 14 and the side window 18 are arbitrary as long as the first sub display section 86A and the main display section 85 are visible. Also, the forward window cover 42 and the side window cover 44 may be omitted.

Moreover, a top window may be provided in place of or in addition to the forward window 14. Also, it is preferable that the top window is made up of a top window which communicates with the cartridge loading section 6 and a top window cover which covers this. However, in this case, it is assumed that the sub display sections (first sub display section 86A, second sub display section 86B) are provided also on the top peripheral surface of the ink cartridge.

Configuration of Tape Printing Device 1A

Second Embodiment

Figure 7:
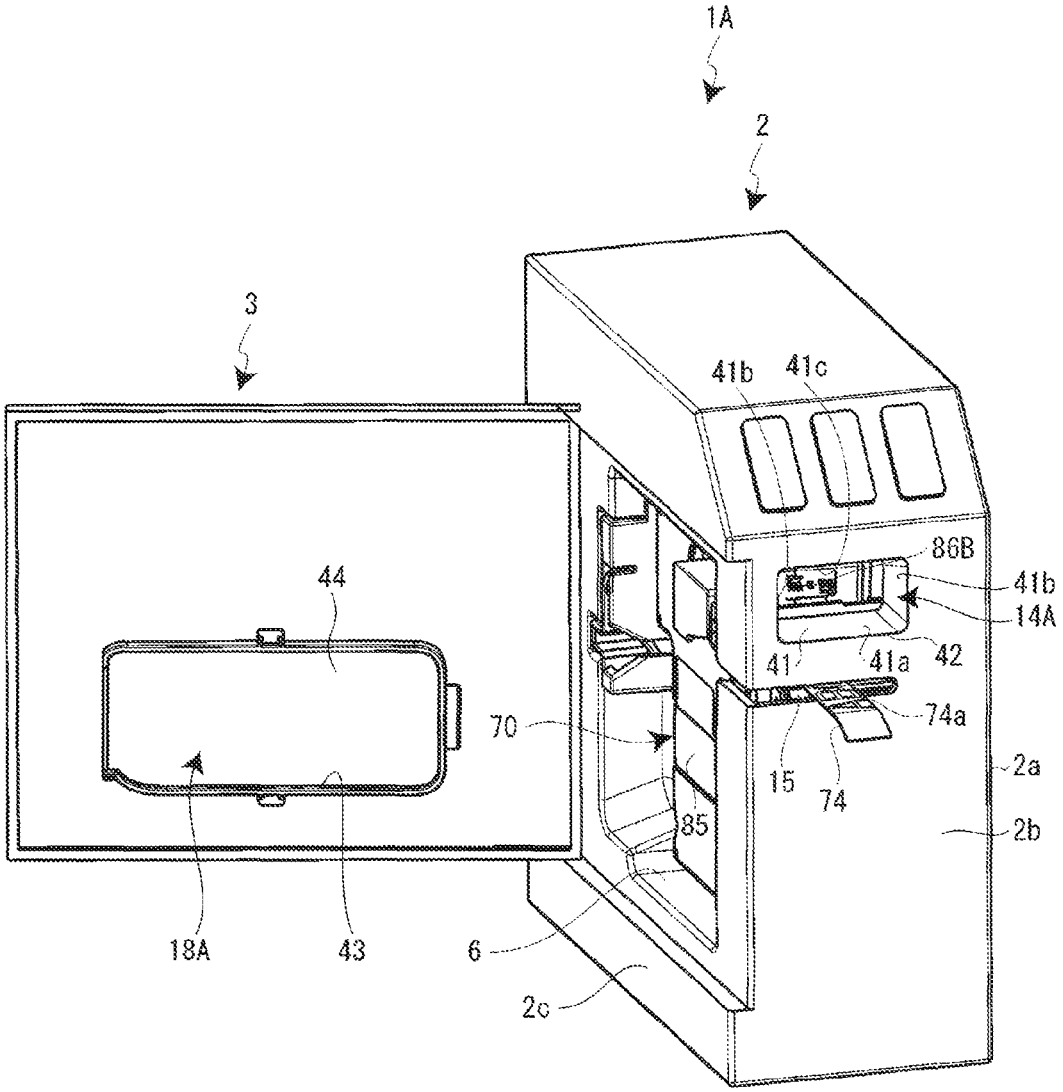
FIG. 7 is an external perspective view schematically showing a tape printing device according to the second embodiment in an open-lid state.

Next, a tape printing device 1A according to a second embodiment will be described, referring to FIG. 7. In the second embodiment, different parts from the first embodiment will be mainly described. In this embodiment, the tape printing device 1A has a configuration in which the print tape 74 is discharged with a print surface 74*a* thereof facing upward so that the print result can be visually confirmed easily and in which the second sub display section 86B can be visually confirmed easily through a forward window 14A. Also, in the second embodiment, the internal device 4 of the tape printing device 1 of the first embodiment in the state of being inverted upside down and laterally inverted is incorporated in the device case 2, and the foregoing configuration change is thus made possible without changing the design of the internal device 4.

Specifically, in the tape printing device 1A of the second embodiment, the cartridge loading section 6 and the open/close lid 3 are arranged on the left-hand side surface 2*c* of the device case 2, and the internal device 4 (in the state of being inverted upside down and laterally inverted) is incorporated around the cartridge loading section 6. Thus, the print head 21 forming the print unit is in the state of being arranged, facing downward.

Also, the tape cartridge 70 is loaded accordingly in the vertically inverted posture of FIG. 1 (*b*) in the cartridge loading section 6. Thus, the print tape 74 of the tape cartridge 70 is reeled off (discharged) from the tape discharge port 15, with the print surface 74*a* facing upward.

Meanwhile, in this embodiment, the forward window 14A is provided above the tape discharge port 15 in order to make the sub type indications 92 on the tape cartridge 70 and the print result on the print tape 74 visible simultaneously. Therefore, the forward window 14A and a side window 18A provided in the open/close lid 3 are vertically misaligned from each other, and unlike the first embodiment, the forward window cover 42 and the side window cover 44 are not formed as a unit (cover unit 45). Also, the second sub display section 86B on the tape cartridge 70 faces the forward window 14A.

Therefore, the forward window 14A in the second embodiment is made up of the rectangular forward window opening 41 (first window opening) and the forward window cover 42 (first window cover) covering the forward window opening 41. Similarly, the side window 18A is made up of the rectangular side window opening 43 (second window opening) provided in the way of penetrating the open/close lid 3 and the side window cover 44 (second window cover) covering the side window opening 43. Also, the forward window 14A may be configured to communicate with the cartridge loading section 6, as in the tape printing device 1 described in the first embodiment.

In such a configuration, the second sub display section 86B can be visually confirmed through the forward window 14A and the print result (print surface 74*a*) on the print tape 74 can be visually confirmed with a small movement of the eyes. That is, not only the type of the tape cartridge 70 but also whether a desired print result is achieved or not can be confirmed without changing the posture of the tape printing device 1A placed in a narrow space on the desk.

By the way, the tape printing device 1A of the second embodiment can also have a configuration in which the tape printing device 1 of the first embodiment is simply laterally inverted (modification of the second embodiment). Although not particularly illustrated (see FIG. 3), in this modification, as in the first embodiment, it is possible to form the forward window cover 42 and the side window cover 44 as a unit. However, in this case, a configuration in which the forward window 14 is provided below the tape discharge port 15 and in which the first sub display section 86A is visually confirmed through the forward window 14, is employed.

The user usually confirms the type of the print tape before starting printing, that is, before the print tape 74 is discharged. Even if the forward window 14 is arranged below the tape discharge port 15, this poses no problem in the confirmation of the type of the print tape 74. Therefore, also in this modification, not only the type of the tape cartridge 70 but also whether a desired print result is achieved or not can be confirmed without changing the posture of the tape printing device 1 placed in a narrow space on the desk.

The invention claimed is:

1. A tape cartridge comprising:

a cartridge case;

a print tape accommodated in the cartridge case;

a slit-like tape outlet which is formed in the cartridge case and through which the print tape is sent out; and a first display section which is provided on a first surface of the cartridge case where the tape outlet is formed, and in which a type of the print tape is displayed;

wherein in the first display section, the type of the print tape is displayed in at least one of normal letters formed according to the tape outlet as a horizontal reference and inverted letters formed by inverting the normal letters upside down, and a case wall of the cartridge case forming a second surface is formed in such a way that a wound state of the print tape is visible.

2. The tape cartridge according to claim 1, wherein the first display section is provided on one of a surface on the side of a print surface of the print tape that is sent out and a surface on the side of a non-print surface, split by the tape outlet as a boundary, on the first surface.

3. The tape cartridge according to claim 1, further comprising a second display section where the type of the print tape is displayed on the second surface of the cartridge case located to the forward side in a direction in which the tape cartridge is loaded, wherein in the second display section, the type of the print tape is displayed in the form of at least one of the normal letters formed according to the tape outlet as a horizontal reference and the inverted letters.

4. A tape printing device comprising:

a tape loading section in which the tape cartridge according to claim 1 is loaded in such a way that the print surface of the print tape at a reel-off end part faces upward;

a print unit having a print head arranged to face downward to the reel-off end part;

a device case in which the tape loading section and the print unit are arranged and which has a tape discharge port through which the print tape is discharged in a posture with the print surface facing upward; and a first opening which is formed on a first outer surface of the device case where the tape discharge port is formed, and which is formed in such a way that the first display section of the tape cartridge is visible.

5. The tape printing device according to claim 4, wherein the first display section is provided on a surface on the upper side that is a surface on the side of the print surface of the print tape, on the first surface, and the first opening is provided on an outer surface on the upper side of the tape discharge port, on the first outer surface.

6. The tape printing device according to claim 4, wherein the first outer surface is a forward surface of the device case.

7. The tape printing device according to claim 6, wherein the tape cartridge is loaded removably in the cartridge loading section from the lateral side, and the first opening communicates with the cartridge loading section and is opened to the lateral side.

8. The tape printing device according to claim 7, further comprising:

an open/close lid which opens and closes the cartridge loading section; and a second opening which is provided in the open/close lid and through which the second display section and the wound state of the print tape are visible over the case wall.

9. The tape printing device according to claim 8, wherein the first opening is provided with a first opening cover having light transmissivity with respect to visible light, and the first opening cover is attached to the open/close lid.

10. The tape printing device according to claim 9, wherein the first opening cover has a finger hook part for causing the open/close lid to open and close.

11. The tape printing device according to claim 9, wherein the second opening is provided with a second opening cover having light transmissivity with respect to visible light, and the first opening cover and the second opening cover are molded as an integrated part and attached to the open/close lid.

12. The tape printing device according to claim 4, wherein the first opening is open, extending upward with respect to the first display section.

13. The tape printing device according to claim 4, wherein a lower edge surface forming the first opening is made up of a light reflection surface.

14. A tape cartridge comprising:

a cartridge case;

a print tape accommodated in the cartridge case;

a slit-like tape outlet which is formed in the cartridge case and through which the print tape is sent out;

a first display section which is provided on a first surface of the cartridge case where the tape outlet is formed, and in which a type of the print tape is displayed; and a second display section where the type of the print tape is displayed on a second surface of the cartridge case located to the forward side in a direction in which the tape cartridge is loaded, wherein in the first display section, the type of the print tape is displayed in at least one of normal letters formed according to the tape outlet as a horizontal reference and inverted letters formed by inverting the normal letters upside down, and in the second display section, the type of the print tape is displayed in the form of at least one of the normal letters formed according to the tape outlet as a horizontal reference and the inverted letters.

* * * * *